United States Patent [19]

Ratnik et al.

[11] Patent Number: 5,031,832

[45] Date of Patent: Jul. 16, 1991

[54] AUTOMATED SNOW-MAKING SYSTEM

[75] Inventors: H. Ronald Ratnik, Pittsford; Mark R. Meadows, Rochester; John L. Stephens, Geneva, all of N.Y.

[73] Assignee: Ratnik Industries Inc., Victor, N.Y.

[21] Appl. No.: 470,955

[22] Filed: Jan. 26, 1990

[51] Int. Cl.[5] ..... F25C 3/04

[52] U.S. Cl. ..... 239/14.2; 239/281; 239/587

[58] Field of Search ..... 239/2.2, 14.2, 280.5, 239/281, 532, 587

[56] References Cited

U.S. PATENT DOCUMENTS

| | | | |
|---|---|---|---|
| 3,074,649 | 1/1963 | Atkinson | 239/281 |
| 3,814,319 | 6/1974 | Loomis | 239/14.2 |
| 3,964,682 | 6/1976 | Tropeano et al. | 239/14.2 |
| 4,199,103 | 4/1980 | Dupre | 239/14.2 |
| 4,511,083 | 4/1985 | Muller-Girard | 239/14.2 |
| 4,545,529 | 10/1985 | Tropeano et al. | 239/14.2 |
| 4,561,459 | 12/1985 | Jackman | 239/587 |

FOREIGN PATENT DOCUMENTS

| | | | |
|---|---|---|---|
| 2573854 | 5/1986 | France | 239/14.2 |

*Primary Examiner*—Andres Kashnikow
*Assistant Examiner*—Karen B. Merritt
*Attorney, Agent, or Firm*—Warren W. Kurz

[57] ABSTRACT

A remote-controlled snow-making system responds to certain electrical signals to control the quality (i.e., moisture content) of the snow produced by such system and the direction in which the snow is projected. The system comprises a plurality of conventional snow-guns, each being connected to water and compressed air supplies via motor-controlled valves. The relative settings of such valves determines the water-to-air ratio within the gun and, hence, snow quality. Each snow-gun is movably mounted so that the direction in which it projects a spray of machine-made snow can be adjusted in both elevation and azimuth. Separate motors control the elevation and azimuth positions of each snow-gun. A control circuit, remotely addressable, e.g., by radio waves, controls the operation of the motor-controlled valves and the gun-position motors. By virtue of the invention, man-made snow can be produced more efficiently, more reliably, and with substantially less human involvement and, hence, cost.

9 Claims, 8 Drawing Sheets

AUTOMATED SNOW-MAKING SYSTEM

BACKGROUND OF THE INVENTION

This invention relates to the art of making snow for ski resorts and the like. More particularly, it relates to improvements in snow-making apparatus so that large volumes of high quality snow can be produced where needed with minimal operator involvement.

Though the art of snow-making has been known for several decades, the application of the art to the business of making snow at ski resorts has presented many challenges. While it's a relatively simple matter to combine water and compressed air in such a manner as to produce, under controlled conditions, a uniform blanket of "high quality" snow (i.e. snow having a desirable moisture content), it's considerably more difficult to produce such snow on a mountan top where the terrain is steep, the winds shift and the temperature and humidity frequently undergo the type of change that affects the quality of the snow produced. For example, it is not uncommon to discover in the morning following a night of snow-making that, as a result of a wind shift or unexpected temperature rise, most of the artificial snow made has either been blown into the woods adjacent the ski trail intended for the deposit, or become so laden with moisture that the "slushy" deposit has frozen to a treacherous mass that, prior to skiing, must either be pulverized or covered over. In either case, most of the cost of the previous night's snow-making operation has been wasted.

To help cope with changing weather conditions so that the snow-making effort more closely matches the intended results, many ski resorts maintain large crews of equipment operators. Much of the time of these crews is occupied in tending the "snow-guns", i.e. the snow-making devices which combine water and compressed air in the requisite manner to produce a spray of ice crystals. Obviously, the spray of these guns should always be aimed in a direction to compensate for windage; otherwise, the snow deposit will miss its mark. Also, the ratio of the water and compressed air should always be set on the basis of the present temperature and relative humidity; otherwise, the snow consistency will be either too wet or too dry. As temperatures increase, for example, less water is needed to achieve a nominal snow consistency or quality. As described below, both of these tasks are relatively labor-intensive and, as as result, add considerably to the cost of snow-making.

In the process of tending the snow-guns, it is common for teams of two people to work together in making the adjustments necessary to achieve a desired pattern of coverage and a desired snow consistency. Typically, each snow-gun is disposed on an adjustable mount that provides for manual azimuth and elevation adjustments so that the direction in which the gun projects a spray of snow can be controlled. A detent arrangement on the gun mount, such as disclosed in U.S. Pat. No. 4,759,503, allows the operator to aim the gun in certain predetermined directions. In aiming the gun, it is common for one team member to make the manual adjustments while the other member checks the coverage pattern, as affected by the wind, and calls out instructions. Similarly, in achieving a desired snow consistency, one team member manually adjusts the valves used to control the water and air supplied to the gun in response to the directions of the other member who monitors the falling snow for consistency. Obviously, the need for two people to make such simple adjustments adds expense to the process and, to the extent possible, should be avoided.

French Pat. No. 2,573,854 to P. Girardin, discloses a computer-controlled system for remotely controlling the water-to-air ratio supplied to a plurality of snow-making sites. Based on the respective outputs of temperature and relative humidity sensors associated with each site, a computer controls the operation of a complex valving arrangement which controls both the water and air supply to an associated snow-gun. While such an automated system is theoretically capable of producing a desired snow consistency for a variety of weather conditions, experience shows that there is no substitute for first-hand sampling of the snow consistency at the time the water and/or air adjustments are made. Moreover, this system provides no means for automating the gun position adjustment to remotely control the direction of snow-making.

SUMMARY OF THE INVENTION

In view of the foregoing, an object of this invention is to reduce the labor costs associated with the operation of snow-guns in an artificial snow-making system.

Another object of the invention is to automate the tasks of aiming and adjusting the output of a snow-gun.

A further object of this invention is to provide an automated snow-making system which allows a single operator to control both snow consistency and the direction of snow-making from a location within, or in close proximity to, the man-made snow spray.

According to the invention there is provided a snow-making system which comprises a plurality of remote-controlled valves for adjusting the ratio of water-to-air supplied to each of a plurality of snow-making devices. The setting of each valve is controlled by a motor which responds to an electrical signal to control the valve opening. Such electrical signal is supplied, on command, by a control circuit which is operable from a remote location by a person who is sampling the artificial snow consistency as it falls.

According to another embodiment of the invention which may be combined with the above feature, the snow-making devices are supported by a mount which can be remotely controlled to vary the azimuthal and elevational positions of each such device to control the direction of snow-making. Such positions are controlled by a pair of motors which function to rotate and pivot the snow-making device. A control circuit, remotely controllable by one who is physically present to observe the direction of snow-making, serves to provide the requisite motor-controlling signals.

The invention and its various advantages will be better understood from the ensuing detailed description of preferred embodiments, reference being made to the accompanying drawings.

DETAILED DESCRIPTION OF PREFERRED EMBODIMENTS

Figure 1:
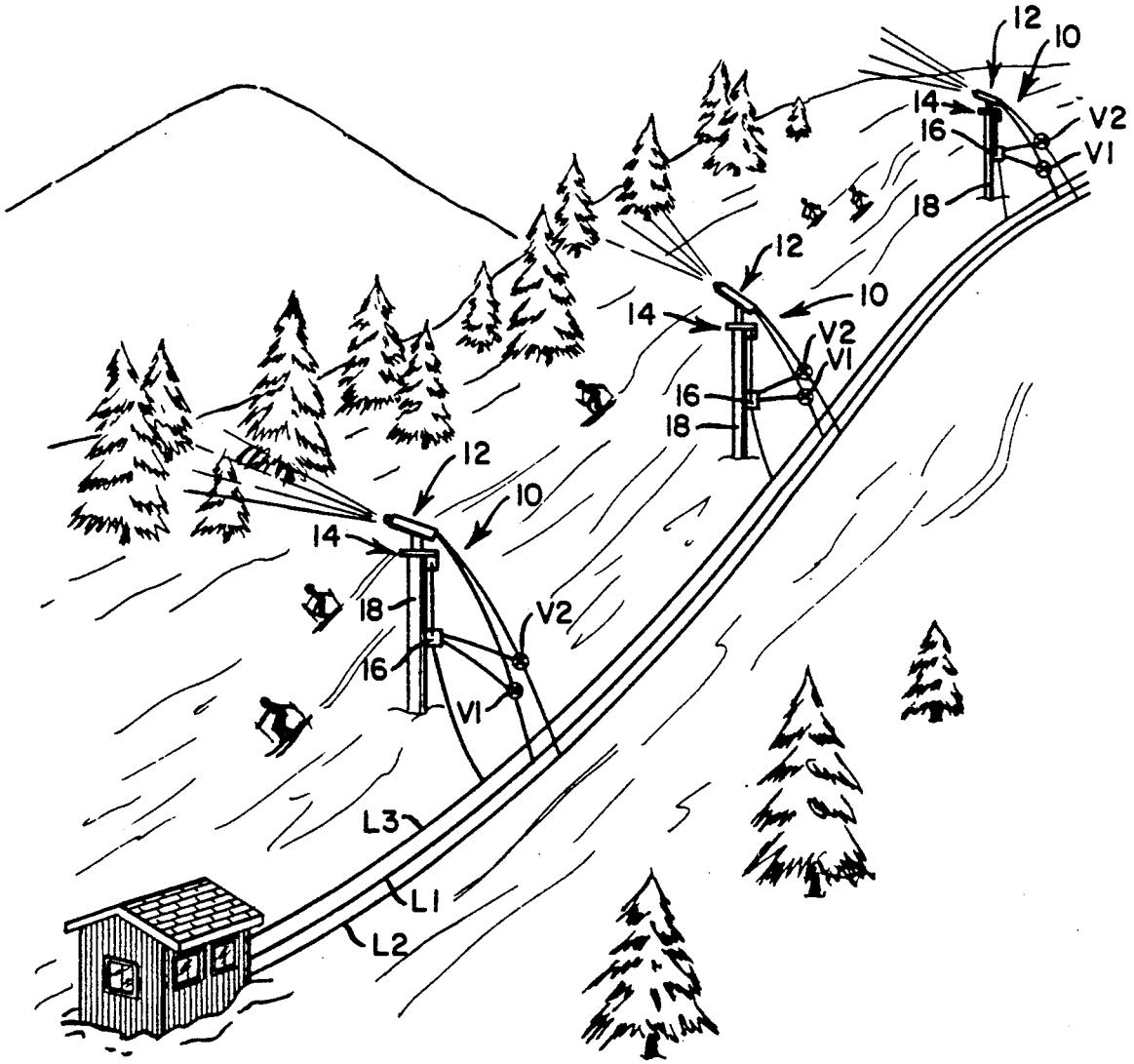
FIG. 1 is a diagrammatic illustration of a snow-making system embodying the present invention.

Referring now to the drawings, FIG. 1 diagrammatically illustrates a snow-making system embodying the present invention. Such system comprises a plurality of snow-making sites 10 arranged at various locations along the ski trails of a ski resort. Each installation comprises a snow-gun 12 which is mounted on a motor-controlled mount 14. Suitable snow-guns are disclosed, for example, in U.S. Pat. No. 3,829,013, issued to H. R. Ratnik. Such guns function, in a well known manner, to provide a spray of ice crystals (i.e. snow) upon combining water and compressed air under certain conditions which need not be described here. It suffices to say that the consistency or "quality" of the snow produced by these devices depends primarily on the existing atmospheric conditions and the relative proportions of the water and compressed air supplied to such devices. Water under high pressure and compressed air are supplied to each gun by water and compressed air lines L1 and L2, respectively. Motor-controlled valves V1 and V2, described below, control the flow of water and air to the snow-guns. The operation of such valves, as well as the operation of the motor-controlled mounts, are controlled by output of a control circuit 16 associated with each installation. As described below, each control circuit 16 can be operated from a remote location, preferably by a hand-held transmitter carried and operated by a person who is in a position to physically sample the man-made snow, as it falls, and to observe, first-hand, the location of the snow deposit.

Figure 2:
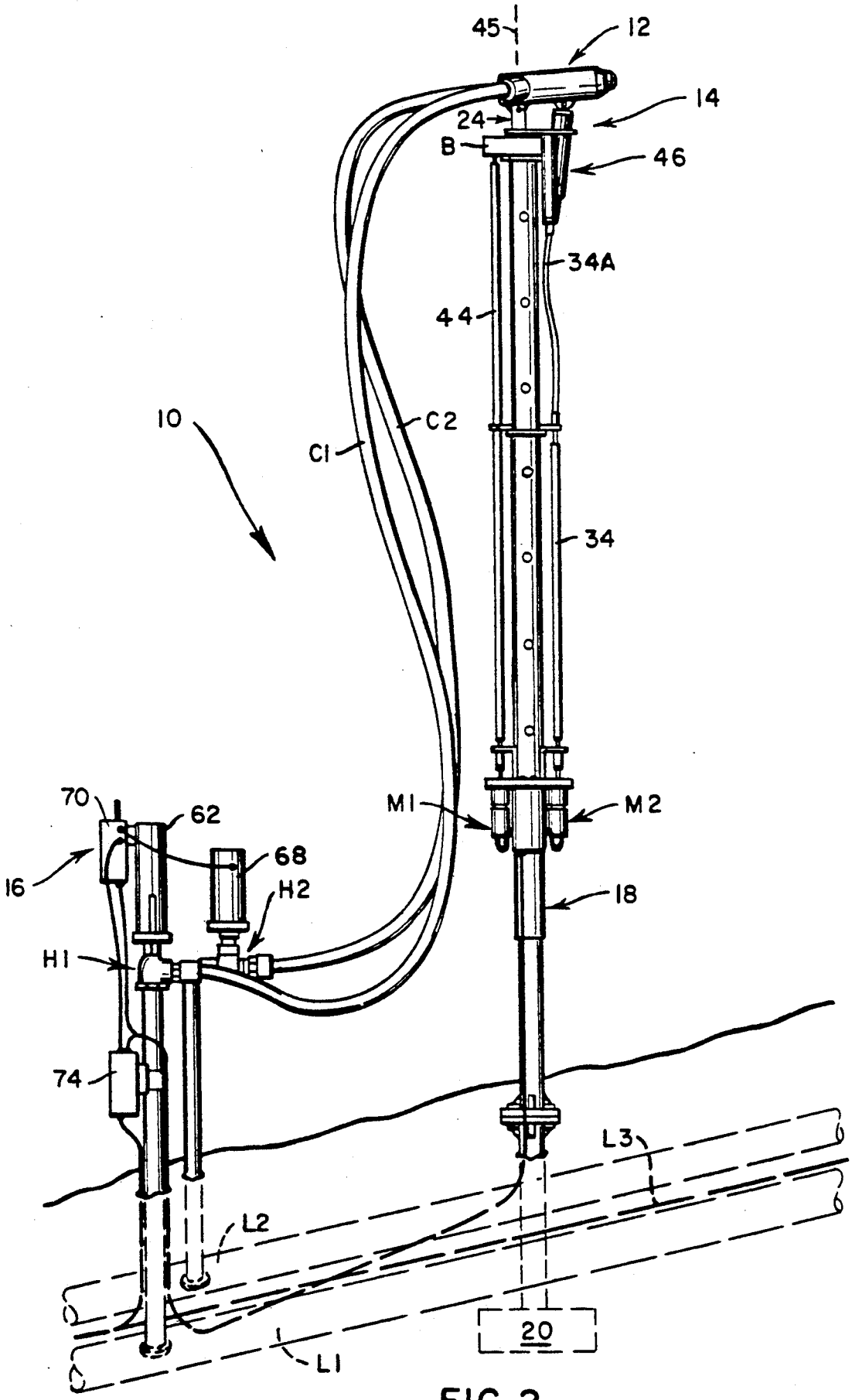
FIG. 2 is a side elevation of a snow-making site of the FIG. 1 system.
Figure 3A:
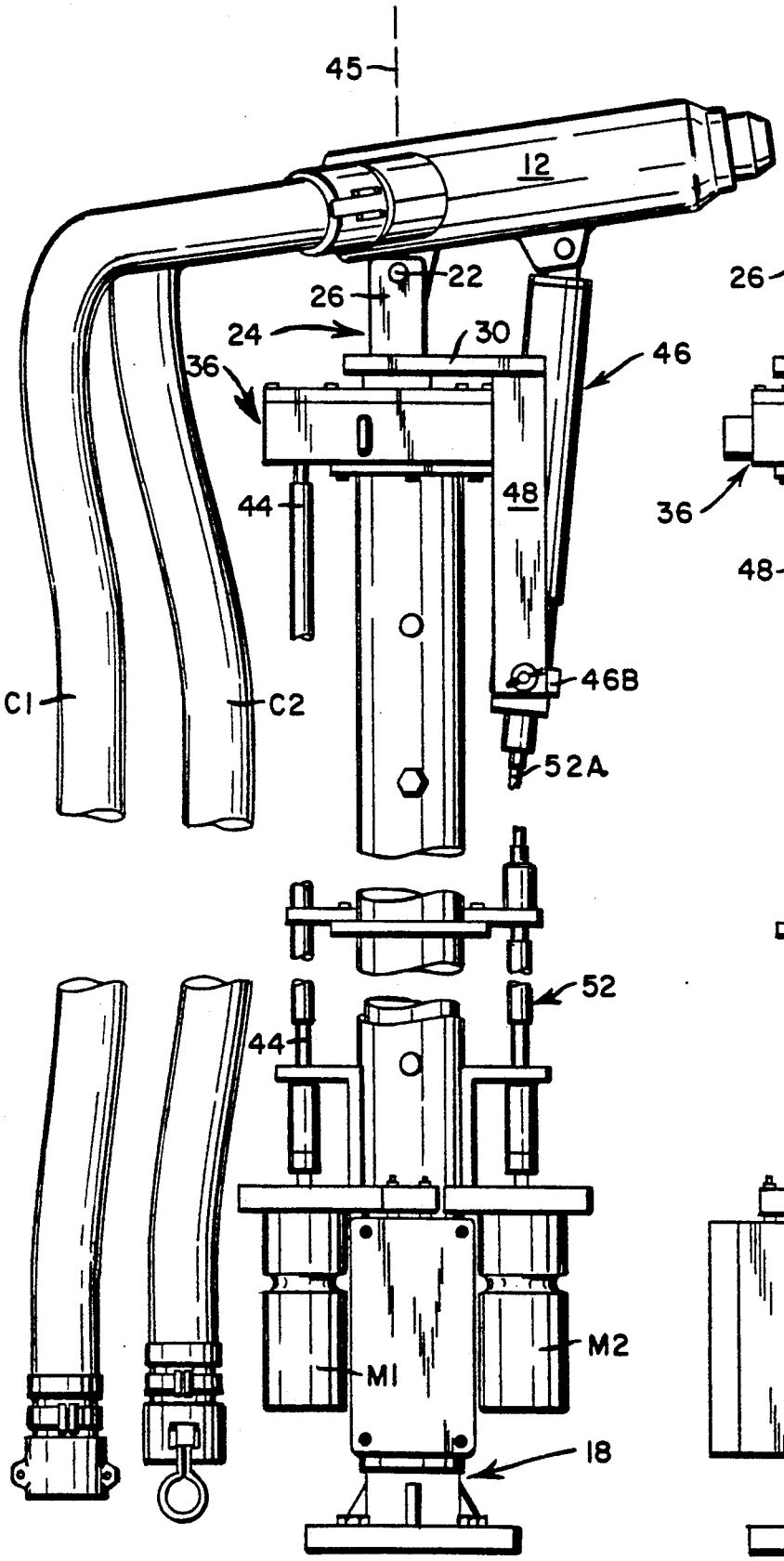
FIGS. 3A and 3B are front and side elevations, respectively, of a motor-controlled support for controlling the direction of snow projection by a snow-making device.
Figure 3B:
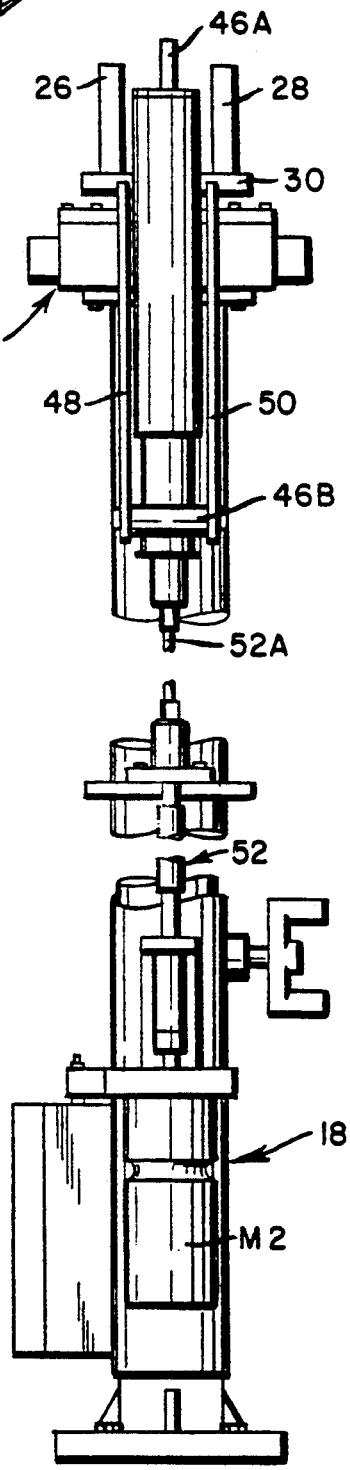
Figure 4:
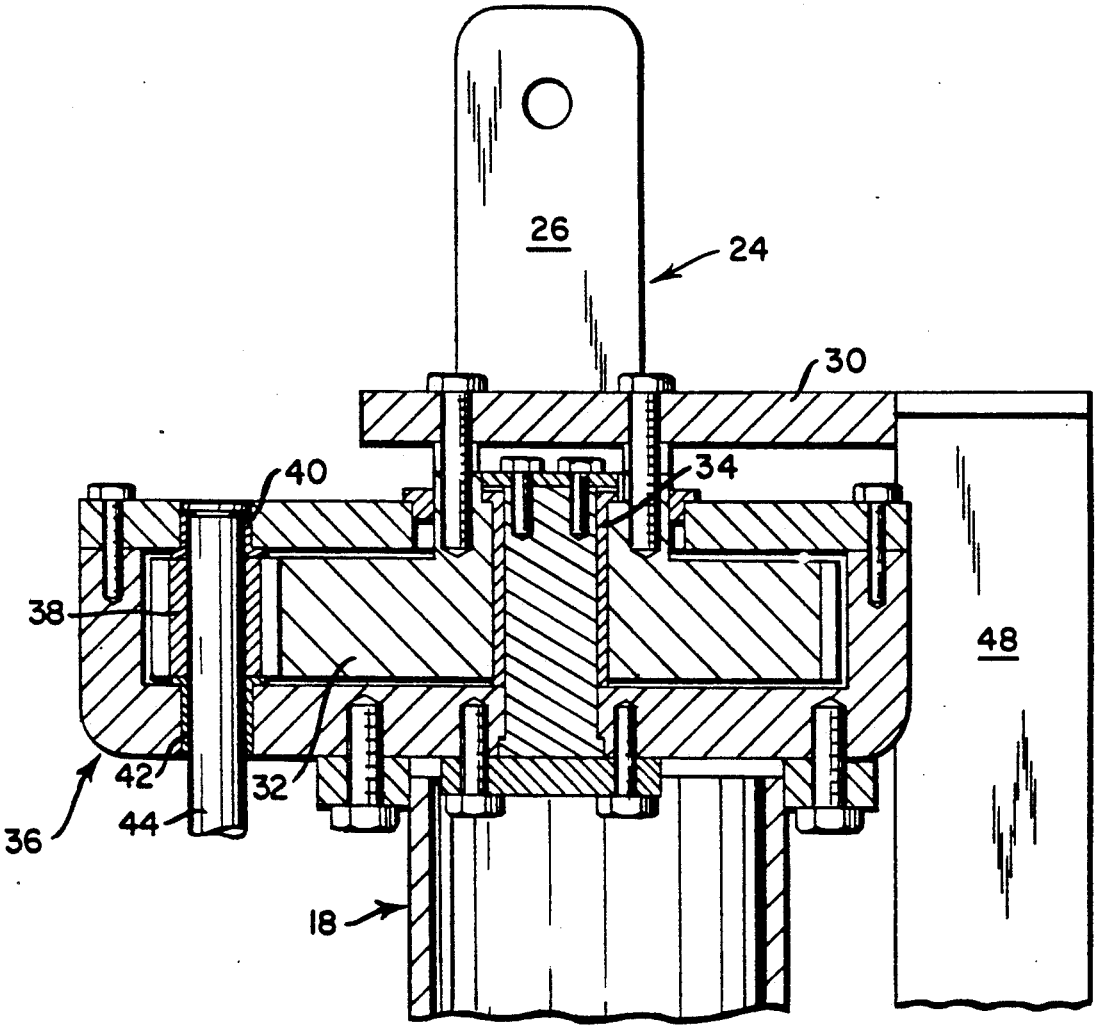
FIG. 4 is a cross-sectional view of a portion of the apparatus shown in FIGS. 3A and 3B.
Figure 5:
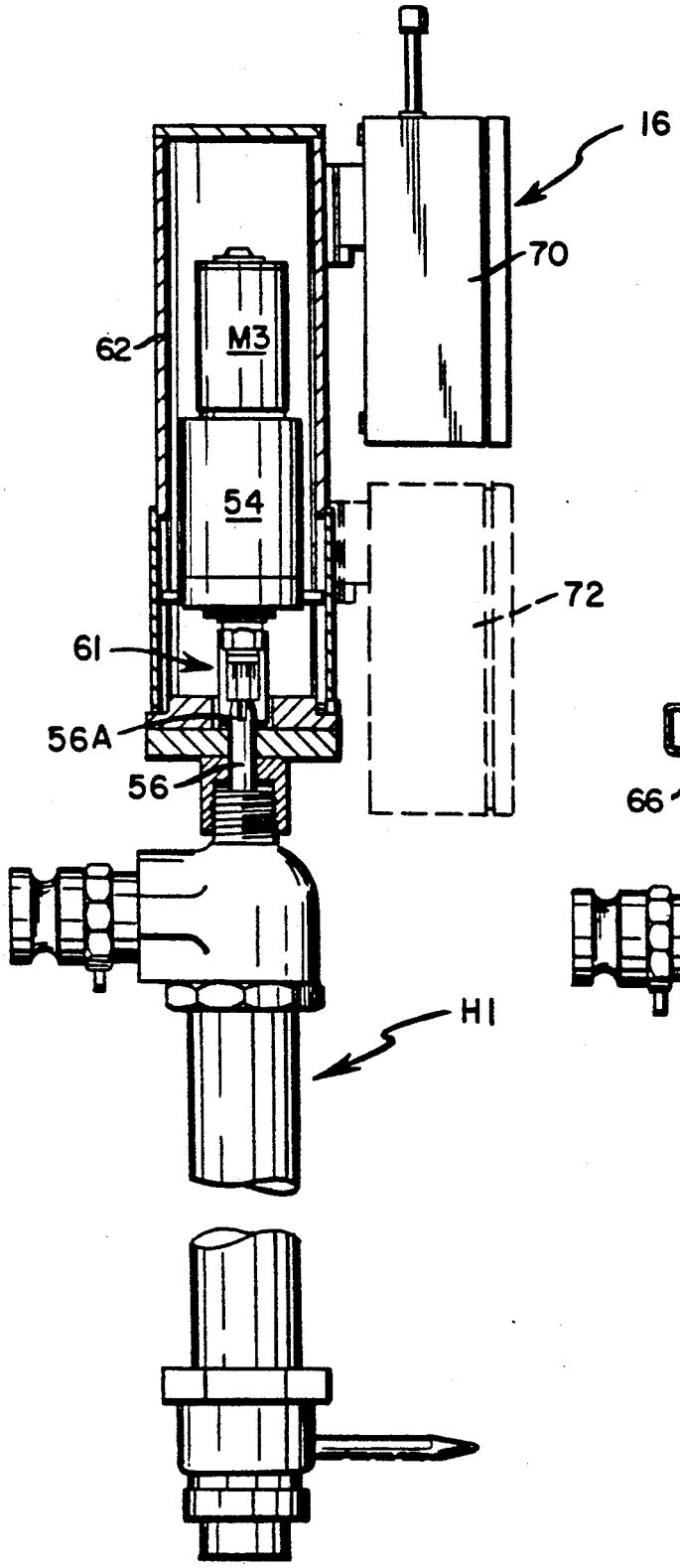
FIG. 5 is an enlarged cut-away view of a motor-controlled water hydrant used to provide the FIG. 2 site with water for snow-making.
Figure 6:
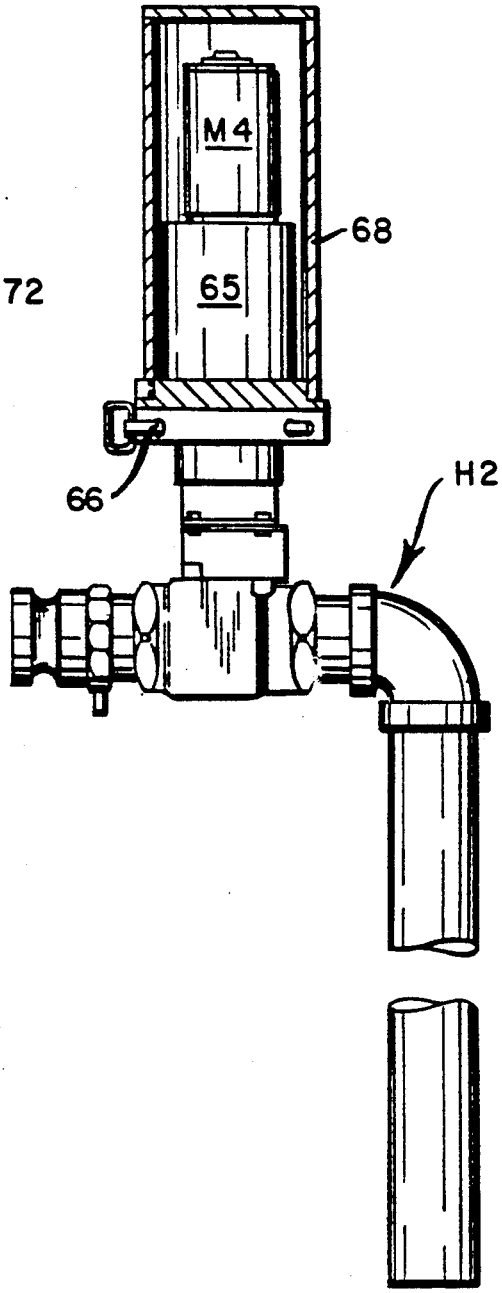
FIG. 6 is a partial cut-away view of a motor-controlled valve used to control the flow of compressed air to the FIG. 2 site.
Figure 7:
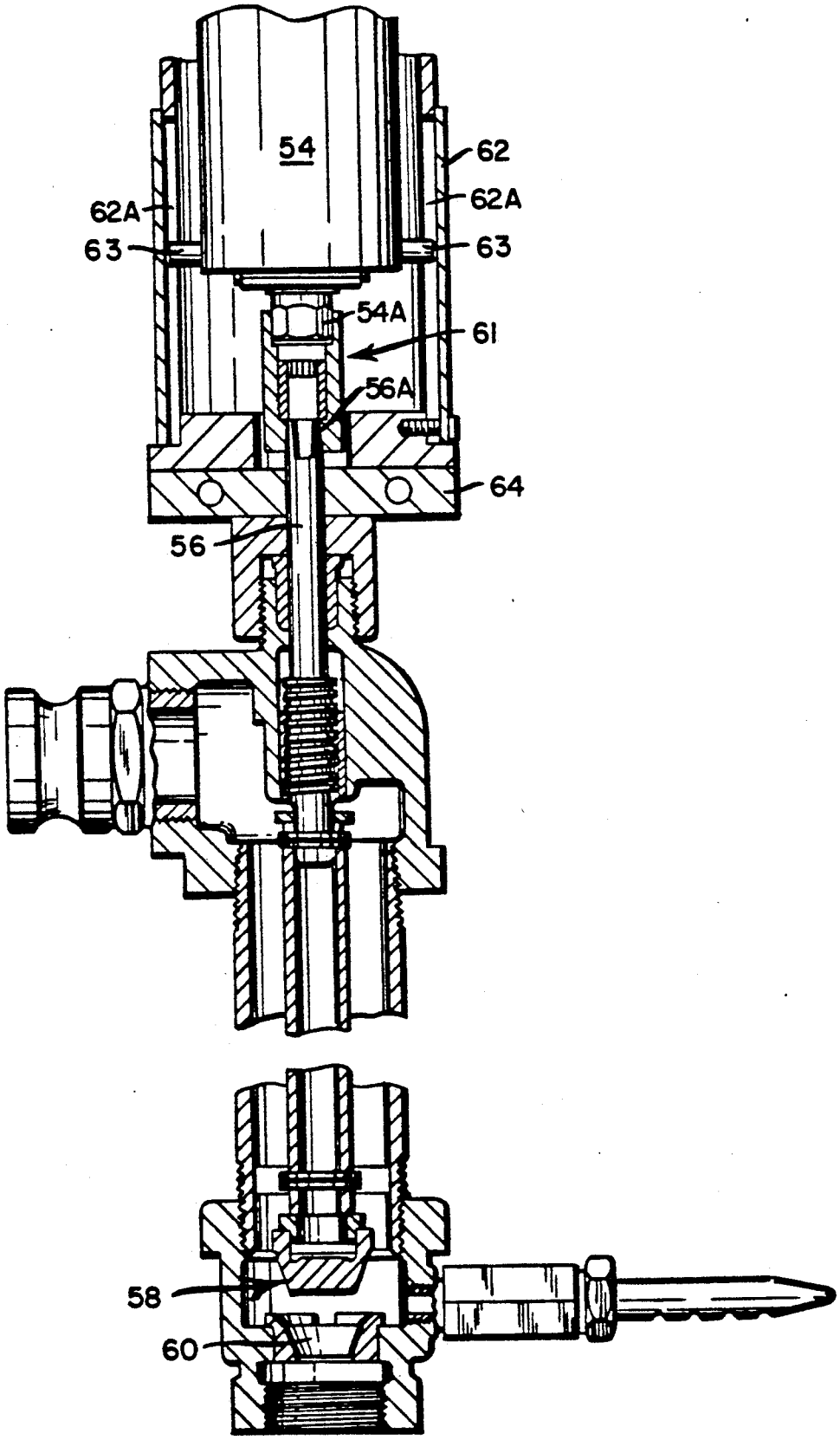
FIG. 7 is a cross-sectional view of the water hydrant shown in FIG. 5.

Referring to FIG. 2 which better shows the mechanical details of each snow-making site, each snow-gun 12 is supported by its motor-controlled mount 14 atop a telescoping tower 18 extending upwardly from a concrete base 20 buried beneath ground level. The structural details of each mount 14 are shown best in FIGS. 3A, 3B and 4. Gun 12 is pivotally supported on a pivot pin 22 carried by a weldment 24 comprising a pair of upright members 26, 28, extending upwardly from a base plate 30. As shown in FIG. 4, plate 30 is rigidly connected to a spur gear 32 which is rotatably mounted by a sleeve bearing 34 within a gear box 36. As shown, gear box 36 is rigidly connected to the top of tower 18. Spur gear 32 is rotatably driven by a pinion gear 38 which is rotatably mounted in the gear box by a pair of bearings 40, 42. The spur gear is keyed to a drive shaft 44 driven by a motor M1 rigidly mounted on the upper, telescoping portion of tower 18. When energized, motor M1 causes weldment 24 to rotate clockwise or counter-clockwise in a horizontal plane, thereby adjusting the azimuthal position of the snow-gun about the vertical axis 45.

The elevational position of the snow-gun is controlled by a jack screw 46, one end 46A of which is connected to the gun and the other end 46B connected to weldment 24, via a pair of downwardly depending members 48, 50 rigidly connected to plate 30. The jack screw is selectively driven in a direction to either raise or lower the gun elevation about pin 22 by means of a motor M2 which operates the jack screw via drive shaft 52. A portion 52A of such drive shaft is flexible to accommodate the movement of the gun about axis 45. Motor M2 is also supported by the telescoping portion of the tower, as shown.

Referring to FIGS. 2 and 5-7, snow-gun 12 is supplied with water and compressed air by a pair of high-pressure hydrants H1 and H2, respectively. Each hydrant comprises a motor-controlled valve which, in response to an electrical signal supplied by the control circuit, opens or closes to regulate the flow of fluid therethrough. In the water hydrant, best shown in FIGS. 5 and 7, the drive shaft of a DC motor M3 operates, via a high gear ratio (i.e., 308:1) gear system 54 to rotate a valve stem 56 which controls the position of a plug 58 relative to a valve seat 60 and, hence the water passing throught the seat. A hollow coupling device 61 serves to connect the hexagonally-shaped drive shaft 54A of the gear system with the tapered top 56A of the valve stem. Motor M3 and its associated gear box are housed in a cylindrical housing 62 which, by means of a quick-disconnect arrangement, can be removed to allow manual operation of the valve in the event of a power failure, for example. The motorized hydrant is best described in the commonly assigned U.S. Pat. application, Ser. No. 470,812, filed concurrently herewith in the name of H. R. Ratnik. Note, to completely open the valve seat 60, the valve stem must undergo a vertical displacement of over one inch. To accommodate such movment, the motor and its gear system are mounted for sliding movement within housing 62. Such sliding movement is provided by a pair of pins 63 extending radially outward from the gear system, and a pair of axially extending slots 62A formed in the opposing sides of housing 62. A pair of pins, not shown, but similar to those shown in the air hydrant depicted in FIG. 6, serve to releasably connect housing 62 and a flange 64 connected to the top of the hydrant. The output of the water hydrant is connected to the snow-gun by a flexible conduit C1.

Compressed air hydrant H2, like water hydrant H1, comprises a DC motor M4 which operates through a high gear-ratio (308:1) gearing arrangement 65 to rotate a valve stem (not shown) which controls the angular position of a ball valve within the hydrant. A pair of pins 66 serve to releasably couple a protective housing 68, which encloses the motor and gear housing, to the top of the hydrant. The output of the compressed air hydrant is connected to the snow-gun by means of a flexible conduit C2.

Control over the operation of motors M1-M4 is provided by control circuit 16 which, as shown, may be housed in a weather-tight housing 70 attached to the water hydrant's protective housing 62. Electric power for the motors and control circuit may be provided by a re-chargeable, low voltage, battery pack 72 mounted on housing 62, as shown in phantom lines. However, it is preferred that the necessary power be provided by buried high voltage lines L3 (e.g. 110 or 220 volt AC power) and a suitable step-down transformer and DC converter 74. A suitable control circuit is described below.

As indicated above, it is highly preferred that the various motor-controlling outputs of control circuit 16 be controllable from a remote location, such as from a location within or in close proximity to the deposit pattern of the man-made snow, by a wireless communication link. From such a location the circuit operator can, for example, personally sample the snow consistency and, based on his findings, operate the circuit to cause more or less water to be supplied to the snow-gun. Similarly, the operator can adjust the azimuth and/or elevation of the gun based on his observations. Having this capability, only one person is needed to perform those tasks which formerly required the cooperation of two people.

Figure 8:
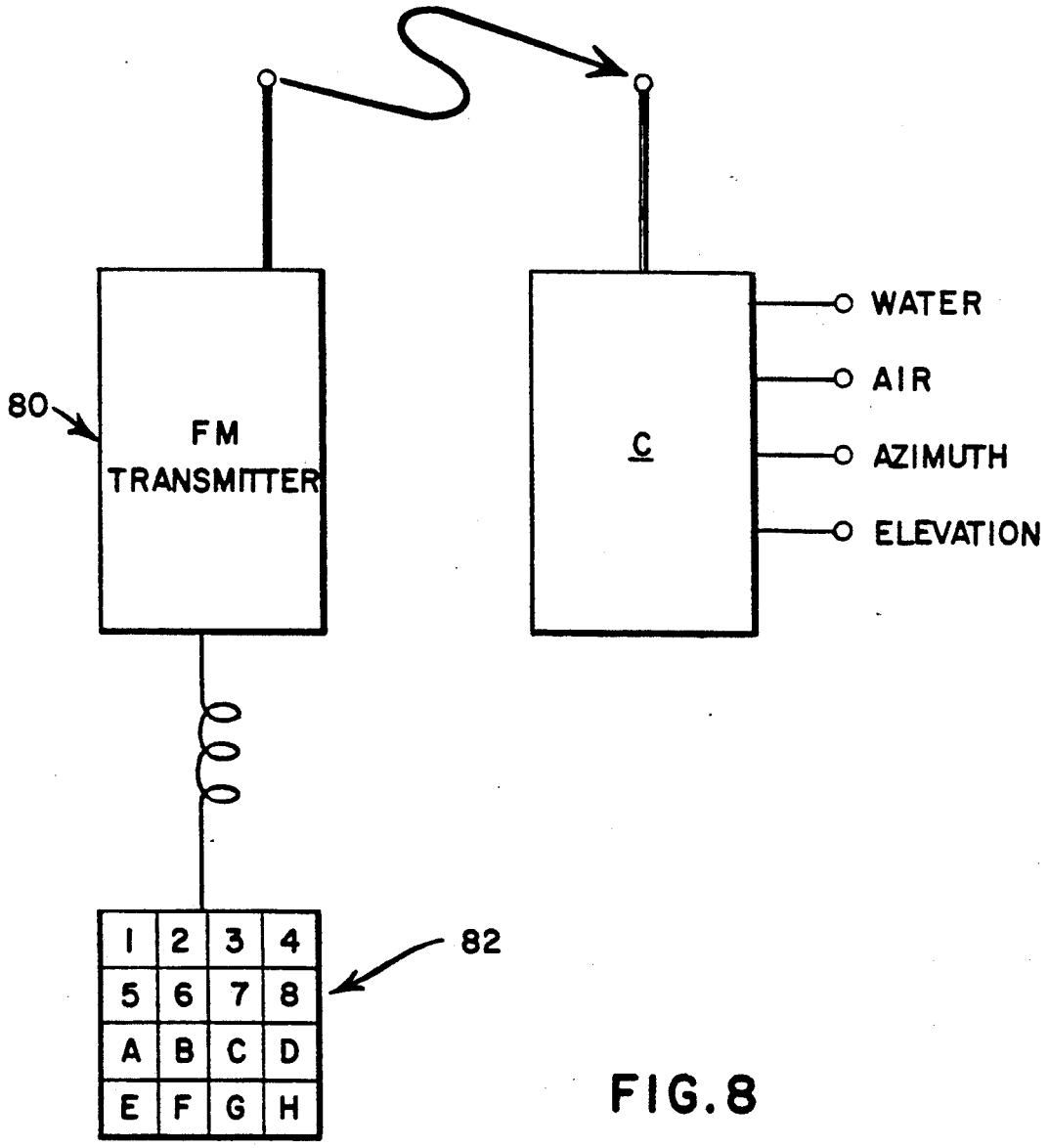
FIG. 8 is a block diagram of a control system for remotely-controlling the operation of the snow-making system of FIGS. 1-6.
Figure 9:
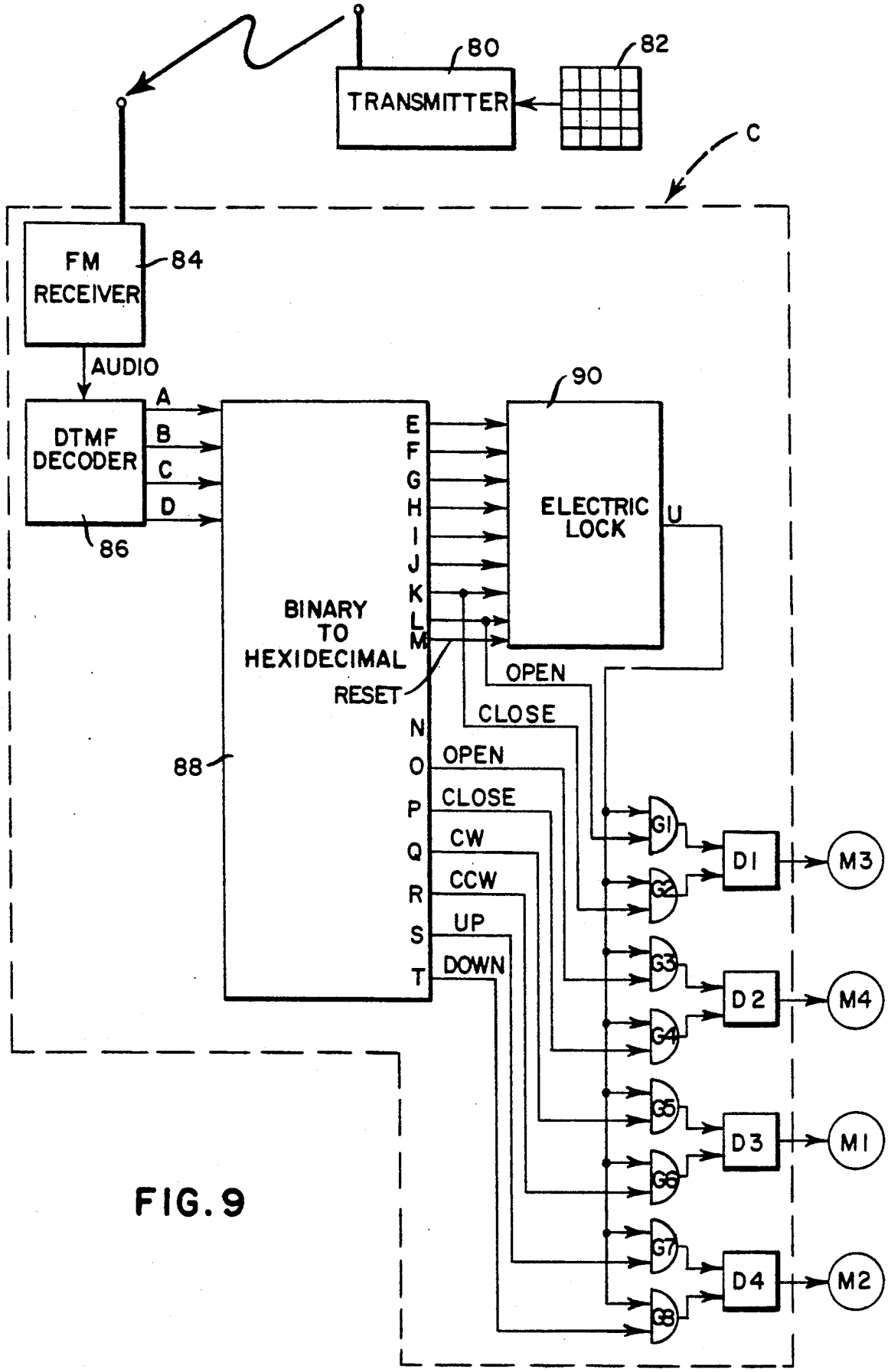
FIG. 9 is a block diagram of a control circuit used in the control system shown in FIG. 8.

Referring to FIGS. 8 and 9, it will be seen that circuit 16 is controllable by the radio waves provided by a conventional FM transmitter 80, or so-called "walkie-talkie", which is equipped with a weather-resistant 16-position keypad 82 which transmits discrete dual-tone multi-frequency (DTMF) signals depending on which key is depressed. These tones are FM-modulated and sent over the air-waves to the control circuit 16 which, as shown in FIG. 9 includes an FM receiver 84 for recovering the audio signal produced by the keypad. The audio output of the FM receiver is fed to a DTMF decoder 86 which provides a digital representation on its four output terminals A–D of the particular tone (one of sixteen possible tones) it receives at its input. The hexadecimal output provided by the DTMF decoder is decoded by a conventional four-to-sixteen decoder 88 which provides a logical output on one of its sixteen output terminals, depending on the hexadecimal received.

Eight of the outputs, shown as outputs E–L, provided by decoder 88 are used to activate an electronic lock 90 which prevents a command intended for one snow-gun site from being acted upon by other sites. Only upon receiving a unique sequence of four signals on outputs E–L of decoder 88 will an "enable" signal be produced on the lock's output U. This enable signal is fed to each of eight different AND gates G1–G8 which, via power drivers D1–D4, control the operation of motors M1–M4. Terminal M of decoder 88 is used to reset the lock and disable the AND gates, e.g., following a motor command sequence. As shown, eight outputs of decoder 88, shown as outputs K,L and O-t, are used to control the opening and closing of the water and compressed air valves operated by motors M1 and M2, respectfully, the clockwise (CW) and counter-clockwise (CCW) rotation of the gun (i.e., the azimuth position), as controlled by motor M3, and the up/down elevation of the gun, as controlled by motor M4. Note, as a result of the AND gates, the outputs of decoder 88 are only effective to operate the respective motors M1–M4 when the enable signal is produced by lock 90.

From the foregoing, it will be appreciated that the aforedescribed, labor-intensive snow-making operation has been automated to a major extent by the apparatus of the invention, making it possible to provide adjustments to the snow-guns on a more frequent and reliable basis and with a smaller labor force. As a result, the cost of making snow can be reduced and quality of such snow can be improved.

While the invention has been described with particular reference to a preferred embodiment, it will be appreciated that modifications can be made without departing from the spirit of the invention. For example, for certain applications, it may not be necessary to control all four of the parameters described in this specification; for some applications it may be desiable to control only the gun position or the snow consistency. Also wireless communication links other than FM-modulated radio waves could be used, such as infrared and ultrasonic signals. Such variations are intended to fall within the scope of the appended claims.

We claim:

1. An automated snow-making system comprising:

a) a plurality of snow-making devices, each being adapted to produce a spray of artificial snow from a combination of compressed air and water supplied thereto from compressed air and water supplies;

b) motor-controlled valve means operatively coupled between each of said snow-making devices and supplies of compressed air and water, each of said valve means being responsive to a first electrical signal to control the water-to-air ratio supplied to an associated snow-making device;

c) support means for movably supporting each of said snow-making devices so that the direction in which said devices produce snow is adjustable;

d) motor means operatively coupled to each of said support means and responsive to a second electrical signal for adjusting the direction in which said devices produce snow; and e) electronic control means, operatively associated with each of said snow-making devices, for selectively providing said first and second electrical signals to said motor-controlled valve means and to said motor means.

2. The apparatus as defined by claim 1 wherein said electronic control means is electrically controllable from a remote location by a wireless communications link.

3. The apparatus as defined by claim 1 wherein said electronic control means is remotely controllable by radio waves.

4. The apparatus as defined by claim 1 wherein said support means comprises means for adjusting the azimuth and elevation of said devices, and wherein said motor means is operatively coupled to said adjusting means to control both the azimuth and elevation of said spray.

5. An automated snow-making system comprising:

a) a plurality of snow-making devices, each being adapted to produce a spray of artificial snow from a combination of compressed air and water supplied thereto from compressed air and water supplies;

b) motor-controlled valve means operatively coupled between each of said snow-making devices and a supply of water, each of said valve means being responsive to a first electrical signal to control the water-to-air ratio supplied to an associated snow-making device;

c) support means for movably supporting each of said snow-making devices so that the direction in which said devices produce snow is adjustable;

d) motor means operatively coupled to each of said support means and responsive to a second electrical signal for adjusting the direction in which said devices produce snow; and e) electronic control means, operatively associated with each of said snow-making devices, for selectively providing said first and second electrical signals to said motor-controlled valve means and to said motor means.

6. The apparatus as defined by claim 5 wherein each of said motor-controlled valve means comprises a water hydrant having a valve seat through which water can flow, a movably-mounted plug for controlling the flow of water through said valve seat, a valve stem operatively connected to said plug and rotatable to control the position of said plug relative to said valve seat, and a motor, responsive to an applied electrical signal, for selectively rotating said valve stem.

7. The apparatus as defined by claim 5 wherein said electronic control means is controllable from a remote location by a wireless communications link.

8. The apparatus as defined by claim 7 wherein said electronic control means is controllable by radio waves.

9. The apparatus as defined by claim 5 wherein said support means comprises means for adjusting the azimuth and elevation of said devices, and wherein said motor means is operatively connected to said adjusting means for controlling both the azimuth and elevation of the spray.

* * * * *